United States Patent [19]

de Mena et al.

[11] 4,451,003

[45] May 29, 1984

[54] CONTROL SCHEME AND APPARATUS FOR A COGENERATION BOILER

[75] Inventors: Henry F. de Mena, Florham Park; Michael A. Tanoff, Highland Park, both of N.J.

[73] Assignee: Exxon Research and Engineering Co., Florham Park, N.J.

[21] Appl. No.: 502,816

[22] Filed: Jun. 9, 1983

[51] Int. Cl.[3] ..... F23H 1/08

[52] U.S. Cl. ..... 236/14; 122/448 R; 122/479 B; 208/8 LE

[58] Field of Search ..... 122/448 R, 448 B, 449, 122/479 B; 236/14; 208/8; 436/55

[56] References Cited

U.S. PATENT DOCUMENTS

| | | | |
|---|---|---|---|
| 3,774,396 | 11/1973 | Borsi et al. | 236/14 X |
| 4,003,342 | 1/1977 | Hodgson | 236/14 X |
| 4,373,663 | 2/1983 | Hammer | 122/448 R |

*Primary Examiner*—Edward G. Favors

*Attorney, Agent, or Firm*—Wayne Hoover

[57] ABSTRACT

An improved control system and method for maintaining the outlet temperature of a process fluid exiting from a process fluid coil located in the convection section of a boiler having a convection section and a radiant section. The improved control system and apparatus comprise means for measuring the inlet temperature and the flow rate of a process fluid to the process fluid coil and means for measuring the temperature of the process fluid at the outlet of the process fluid coil. The improved control method and apparatus also comprise a first means responsive to changes in the inlet temperatures and flow rate to vary the amount of flue gas recirculated from the convection section of the boiler to the radiant section and a second means responsive to changes in the outlet temperature of said process fluid to vary the amount of fuel feed to the combustion section of said boiler. A boiler in combination with the improved control system and apparatus is particularly useful in controlling the coil outlet temperature of a hydrocarbon process fluid and offers distinct advantages in heating the feed slurry to a coal liquefaction process.

6 Claims, 1 Drawing Figure

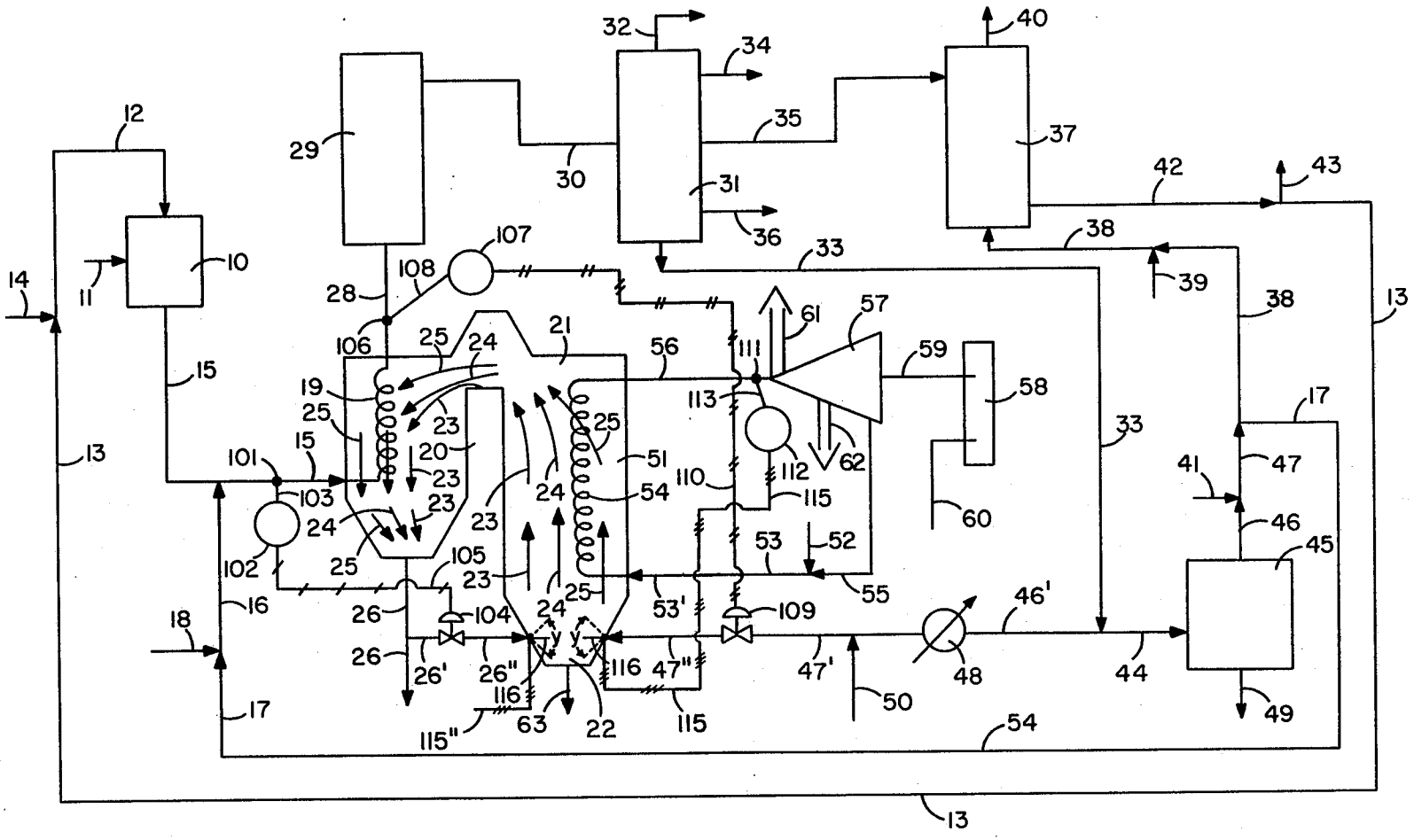

CONTROL SCHEME AND APPARATUS FOR A COGENERATION BOILER

BACKGROUND OF THE INVENTION

This invention relates to a method and apparatus for controlling a boiler operation and to a boiler comprising the associated control equipment. More particularly, this invention relates to a method of controlling the temperature of the fluid heated in a coil in the convection section of a boiler at its outlet end and to a boiler including such a control scheme.

Boilers which are operated such as to make steam in the radiant section and to heat a process fluid in the convection section are known in the prior art and such a boiler is described in co-pending U.S. patent application Ser. No. 450,720, which was filed on Dec. 17, 1982 in the names of E. Effron, I. D. Crane, Jr., M. L. Merrifield and M. R. Wise. Such a boiler is also described in the patent application corresponding to this co-pending U.S. patent application and in the foreign equivalent applications corresponding to the parent U.S. application. Heretofore, however, it has, apparently, been contemplated that the relative amount of heat transferred in the radiant and convection sections of such a boiler would be effected by conventional techniques such as bypassing all or a portion of the flue gas around the tubes in the convection section by controlling the amount of air used to effect combustion or by controlling the amount of fuel actually combusted in the combustion section of the boiler.

It has now been discovered that these prior art control techniques are not effective in cases where the temperature of the process fluid must be controlled within relatively narrow limits such as in exothermic reaction processes where reactor temperature runaways are possible and processes wherein the process fluid is a hydrocarbon and the same is heated to a temperature at or near the temperature at which coking will occur since these control techniques will not respond quickly enough to prevent relatively broad temperature excursions after an upset in either boiler or process operations. Obviously, when the excursion is above the desired coil outlet temperature such that the process fluid is now exiting the coil outlet at a temperature above that at which temperature runaways in the reactor are possible or at a temperature in the coking region, temperature runaways could lead to a process shutdown or coking could result in plugging of the coil at or near the outlet and force a complete shutdown of the boiler. The need, then, for an improved method of controlling such boiler operations and for a boiler comprising such control is believed to be readily apparent.

SUMMARY OF THE INVENTION

It has now been discovered that the foregoing and other disadvantages of the prior art method of controlling boiler operation can be reduced with the method of the present invention and an improved method and apparatus for controlling boiler operation and an improved boiler provided thereby. It is, therefore, an object of this invention to provide an improved method and apparatus for controlling operation of a boiler and an improved boiler including such method and apparatus. It is still another object of this invention to provide such an improved method and apparatus for controlling boiler operation wherein the coil outlet temperature of the fluid heated in the convection section can be controlled within narrower limits during and immediately after an upset either in boiler operation or in the process for which a fluid is heated in the convection section of said boiler. The foregoing and other objects and advantages will become apparent from the description set forth hereinafter and from the drawings appended thereto.

In accordance with the present invention, the foregoing and other objects and advantages are accomplished by controlling the amount of flue gas from the combustion section passing through the convection section and then recirculated or recycled to the combustion section and by controlling the amount of fuel fed to the combustion section of the boiler. The amount of flue gas actually recirculated or recycled to the combustion section is controlled on a "feedforward" loop which senses changes in the temperature and flow rate of the process fluid at or near the process fluid coil inlet of the convection section. The amount of fuel feed to the combustion section of the boiler is controlled on a feedback loop which senses changes in the temperature of the process fluid at or near the process fluid coil outlet of the convection section. As is indicated more fully hereinafter, the amount of steam produced in the radiant section may be controlled by either manually or automatically adjusting the angle of the burners in the combustion section of the boiler and by adjusting the fuel feed rate to the combustion section of the boiler.

BRIEF DESCRIPTION OF THE DRAWINGS

The FIGURE is a schematic flow diagram of a coal liquefaction process wherein a boiler within the scope of the presently claimed invention is integrated showing the improved method and apparatus for controlling the boiler operation when a coal slurry is the process fluid heated in the convection section.

DETAILED DESCRIPTION OF THE INVENTION

As indicated, supra, the present invention relates to an improved method and apparatus for controlling a cogeneration boiler; i.e., a boiler wherein steam is produced in the radiant section and a process fluid heated in the convection section, and to a boiler comprising such an improved control method and apparatus. As also indicated, supra, the improved method and apparatus for controlling the boiler operation consists of a feedforward loop which senses changes in the flow rate and temperature of the process fluid at or near the coil inlet to the convection section and adjusts the amount of flue gas recirculated to the combustion section of the boiler in response to changes in such temperature and flow rate and a feedback loop which senses changes in the temperature of the process fluid at or near the process fluid coil outlet and adjusts the firing rate or the rate of fuel fed to the combustion section of the boiler. As indicated more fully hereinafter, control of the boiler operation in this manner with suitable apparatus significantly reduces temperature excursions due to upsets in either the process cycle or the steam cycle thereby improving control of the process fluid coil outlet temperature and is effective in reducing the risk of temperature runaways in the process reactor and/or coking when the process fluid is being heated to a temperature at or near its coking temperature. As also more fully pointed out hereinafter, variations in the relative amount of heat transferred in the radiant and convection sections can be effected by varying the angle of the burners in the combustion section of the boiler.

In general, the cogeneration hybrid boiler will be a modification of a conventional boiler fabricated for the production of steam in the radiant section and the heating of a process fluid in the convection section. The modification will, generally, be nothing more than a substitution of tubes in the convection section which are designed for use in the heating of the process fluid to be heated or preheated in the convection section. Generally, the tubes will vary with respect to material of construction depending upon the particular process fluid being heated and in strength depending upon the temperature and pressure at which the process fluid enters and leaves the convection section.

The steam cycle of the cogeneration boiler will be conventional in all respects and will not be described in great detail herein. Generally, the steam will be produced in the radiant section by passing boiler feed water into the water walls or steam coils located in the radiant section. The amount of heat actually used to produce steam may be controlled by controlling the amount of surface area provided in the steam coils, the amount of flue gas recirculated to the combustion section, the angle of the burners in the combustion section of the boiler and by controlling the amount of fuel fed to the combustion section. Generally, steam is withdrawn from the steam coils or superheater at a temperature within the range from about 800° F. to about 1000° F. and at a pressure within the range from about 1000 to about 2000 psig. The steam may be used directly in any application where steam is required, including but not limited to, use in the process directly or used to drive a turbo generator to produce electricity. The electricity thus produced could be used in the operation of the process or sold as such.

In general, any process fluid could be heated in the convection section tubes but the improved method of controlling boiler operation of this invention is particularly applicable to processes wherein relatively close control of the process fluid is necessary or desirable such as in exothermic reaction processes where temperature runaways in the process reactor are possible or when a hydrocarbon process fluid is heated to a temperature near the temperature at which all or a portion thereof will coke or otherwise desirably change composition. The improved method of the present invention is, therefore, particularly useful in controlling the operation of a cogeneration boiler wherein a coal slurry is preheated prior to subjecting the same to liquefaction. Generally, such a slurry is preheated to a temperature within the range from about 650° to about 850° F., either in the presence or absence of molecular hydrogen prior to subjecting the same to liquefaction. For convenience, and for purposes of illustration, the present invention will be described by a reference to a coal liquefaction process but the selection of such a process for description of the invention is not intended to limit the scope of the claimed invention.

When coal or a similar solid carbonaceous material is contained in the process fluid, the coal or similar solid carbonaceous material will, generally, be ground to a finely divided state to facilitate incorporation into a solvent or diluent. The particle size range actually employed is not critical to the invention and, indeed, essentially any particle size range can be employed. After the coal or solid carbonaceous material has been ground, the same is then slurried in a suitable solvent or diluent. Normally, the ratio of coal or solid carbonaceous material (on a moisture-free basis) to solvent or diluent in the slurry will be within the range from about b 1:1 to about 1:3, on a weight basis.

Any of the solvents or diluents known to be useful in the prior art for the liquefaction of coal or similar solid carbonaceous materials can be used as a component in the process fluid heated in the convection section of the improved boiler of this invention. Such solvents or diluents include all types of hydrocarbons and particularly those having a boiling range within the range from about 400° F. to about 900° F. The solvent or diluent may be a straight or branch chain hydrocarbon, a cyclic hydrocarbon, a naphthenic or aromatic hydrocarbon, a phenol or substituted phenol, a hydroaromatic, a heterocyclic compound which may contain oxygen, nitrogen or sulfur or mixtures of any one or more of these materials. Moreover, the solvent or diluent may be inert at the liquefaction conditions or the same may donate hydrogen at these conditions. Particularly effective solvents or diluents include hydrogenated creosote oil and solvent derived from the liquefaction of coal, particularly those boiling within the range from about 400° F. to about 900° F. Solvents derived from the liquefaction of coal are particularly effective when the same are at least partially hydrogenated to produce a solvent containing hydrogen donor species. Such species are believed to be well known in the prior art and many are described in U.S. Pat. No. 3,867,275.

When the improved boiler of this invention is used to heat a coal slurry in the convection section, liquefaction of the coal or similar solid carbonaceous material will be effected by subjecting the process fluid to an elevated temperature and pressure for a period of time sufficient to permit at least partial liquefaction of the coal or solid carbonaceous material. As is well known, conversion of the coal or solid carbonaceous material to a liquid is facilitated by the presence of hydrogen during the liquefaction step. As is also well known, the hydrogen may be provided by any method known to be effective in the prior art, including the use of molecular hydrogen, hydrogen donor solvents, other materials known to yield hydrogen at liquefaction conditions and combinations of these. The liquefaction may be effected either with or without an added catalyst.

In general, the liquefaction is accomplished at a temperature between the range from about 700° F. and about 900° F. and at a pressure within the range from about 1000 psig to about 3000 psig. Generally, the coal/solvent slurry will be held at conditions within the aforesaid specified ranges for a nominal period of time within the range from about 10 to about 200 minutes. As is well known, the liquefaction may be accomplished in a plurality of stages and when multiple stages are employed, total nominal holding times in excess of 200 minutes may be used.

In the method of the present invention, at least 50% of the heat required to effect liquefaction will be supplied by heating the slurry of coal or similar solid carbonaceous material in the convection section of a cogeneration boiler wherein the temperature and flow rate of the slurry is measured with appropriate sensing devices and wherein the signal created by these sensing devices is then used to control the amount of flue gas recirculated to the combustion section of the boiler and wherein the temperature at the outlet of the coil in the convection section is sensed with an appropriate sensing device and the signal created with this device used to control the quantity of fuel fed to the combustion section of the boiler. For convenience, the signals created by the inlet temperature and flow rate and used to control the flue gas recirculation rate will be referred to herein as the feedforward signals and the signal created by the temperature of the process fluid at or near the coil outlet and used to control the fuel feed rate to the combustion section of the boiler will be referred to as the feedback signal. As is believed to be well known in the prior art, the amount of heat transferred in the radiant and convection sections of a boiler can be varied by varying the amount of flue gas recirculated to the combustion section. In this regard, it should be noted that as the amount of flue gas recycled through the combustion section is increased from zero, the amount of heat transferred in the radiant section is reduced and the amount of heat transferred in the convection section is increased. When, with the improved boiler of this invention, it is desired to increase the amount of heat transferred in the convection section as a result of either a reduction in the inlet temperature or an increase in inlet flow rate or both, the amount of flue gas recirculated will be increased as a result of the signals created in the feedforward loop. When a reduction in the amount of heat transferred in the convection section is desired, the amount of flue gas recirculated to the combustion section of the boiler will be reduced by these same signals. In general, it is contemplated that the improved boiler of this invention will be operated at normal conditions with a flue gas recirculation rate within the range from about 9 to about 23 volume percent of the total flue gas passing through the convection section. The feedforward signal then could control the recirculation rate within the range from about 0 to about 35 volume percent of the total flue gas passing through the convection section. As is also believed to be known in the prior art, an increase in the feed rate of fuel to the combustion section of the boiler with a corresponding increase in air or oxygen to this section will increase the temperature of the process fluid at the outlet of the convection section process coils at any given flue gas recirculation rate and at any given burner angle in the combustion section if the flue gas recycle rate and burner angle is maintained constant during such an increase. Similarly, a reduction in fuel feed rate, and a corresponding reduction in air or oxygen feed rate, will result in a reduction in the coil outlet temperature from the convection section at a constant flue gas recycle rate and at a constant burner angle. As a result, when the process fluid temperature at the coil outlet of the convection section is below that desired, the feedback signal will increase the fuel feed rate and the air or oxygen feed rate to the combustion section and when the process fluid temperature at the outlet of the convection section is above that desired, the feedback signal will cause a reduction in these flow rates and compensate for the imperfect control in the feedforward loop.

As indicated more fully hereinafter, and in a preferred embodiment, feed water rates and/or other steam variables such as steam pressure at or near the outlet of the radiant section can be used to either automatically or manually control the angle of the burners in the combustion section in order to control stream production at the desired rate. In this regard, it should be noted that as the angle of the burner is increased toward the convective section, i.e., as the burner outlet or tip is moved closer to the convective section, the amount of heat transferred in the convection section is increased and the amount of heat transferred in the radiant section is reduced. Similarly, when the burner angle is increased in a direction away from the convective section; i.e., as the burner outlet or tip is moved farther from the convective section, the amount of heat transferred in the convective section is decreased and the amount of heat transferred in the radiant section is increased. When the burner angle and/or the amount of flue gas recirculated to the combustion section of the boiler is changed, the feedback signal will adjust the fuel feed and air or oxygen feed rates to the combustion section as may be required to compensate for changes in coil outlet temperature caused by the burner angle and/or flue gas recirculation rate changes.

When a cogeneration boiler or a two cycle boiler is used to produce steam and heat a process fluid, the principle difficulties in controlling boiler operation are associated with the process fluid and the operation of the process to which the process fluid is fed. In this regard, it should be noted that when the process fluid is a slurry, and particularly a slurry of coal or a similar solid carbonaceous material in a solvent or diluent, pumping malfunctions can result in significant increases and decreases in process fluid flow rate to the convection section. When such a pumping malfunction results in a significant decrease in process fluid flow rate, the coil outlet temperature will significantly increase without a reduction in the amount of heat being transferred in the convection section and this could result in a temperature runaway in the liquefaction reactor and/or coking of at least a portion of the process fluid at or near the outlet of the coil in a convection section. It should also be noted that in many processes wherein the process reaction is exothermic or the process fluid comprises a hydrocarbon, temperature excursions in excess of 30° F. above the desired temperature could result in a temperature runaway in the reactor or an undesirable decomposition or conversion of the process fluid such as coking whereas temperature excursions in excess of above 30° F. below the desired temperature could result in a significant reduction in product yields. As a result, it has been determined that a control scheme preventing excursions in excess of 30° F. above or below the desired temperature is necessary to insure effective heating in the convection section of a cogeneration boiler when a process fluid comprising a hydrocarbon is heated therein. Moreover, an obstruction in or downstream of the convection section coil such as that which might result from coking could result in reduced flow through the convection section coil. When such an obstruction occurs, the feedforward signals will promptly reduce the amount of flue gas recirculated through the combustion section and thereby minimize the risk of a temperature runaway in the process reactor or an undesirable conversion, such as coking, within the convection section process heater coils. Concurrently, and in both such cases, the feedback loop will adjust the fuel feed rate to the combustion section of the boiler as required to further control the temperature of the process fluid at or near the outlet of the process fluid coil.

In general, any fuel or combination thereof may be used to fire the cogeneration boiler of this invention. Such fuels include coal, oil and gas. As indicated more fully hereinafter and in a preferred embodiment, however, at least a portion of the fuel will be a solid such as the bottoms product from a coal liquefaction or solid carbonaceous material liquefaction since the improved method and apparatus for controlling the operation of a boiler offer the greatest advantage over the prior art control schemes when a solid fuel is burned in the boiler.

PREFERRED EMBODIMENT

In a preferred embodiment of the present invention, the improved boiler control system and apparatus of this invention will be used to heat a hydrocarbon process fluid, most preferably a coal slurry feed to a coal liquefaction process with a solid fuel. The liquefaction will be accomplished at a temperature within the range from about 750° to about 850° F. at a pressure within the range from about 1500 to about 2500 psig in the presence of a coal derived hydrogen donor solvent and in the presence of molecular hydrogen and the feed slurry will be preheated in the convection section of the improved cogeneration boiler of this invention and the improved method and apparatus for controlling boiler operation of this invention will be used to control the boiler operation. In the preferred embodiment, the boiler operation will be controlled such that the coal feed slurry leaves the convection section preheater coil at a temperature within the range of at least +/−2° F. at normal operations and within the range of +/−30° F. of the set point on the controller after an upset. The nominal holding time during liquefaction will be within the range from about 25 to about 120 minutes and the liquefaction will produce a normally gaseous product, a normally liquid product and a normally solid bottoms product. After liquefaction, the product from the liquefaction stage will be subjected to both atmospheric and vacuum distillation and a normally solid bottoms product having an initial boiling point within the range from about 850° F. to about 1100° F. will be separated from the liquefaction product. In the most preferred embodiment, the bottoms product will contain from about 60 to about 90 weight percent carbon and will be used as at least a portion of the solid fuel burned in the combustion section of the boiler.

In a most preferred embodiment of the present invention, from about 40 to about 100 weight percent of the bottoms product will be used as fuel in the improved boiler of this invention. The bottoms product may be combined with one or more other fuels, preferably a solid fuel, as desired to produce the amount of heat required during the boiler operation. Any remaining bottoms product may be used to produce all or a part of the hydrogen required to effect the liquefaction.

In the preferred embodiment, a sufficient amount of fuel will be combusted in the boiler to produce at least 60% the steam required to effect the liquefaction operation and to provide at least 60 percent of the heat required to effect liquefaction. Also in the preferred embodiment, the amount of fuel subjected to combustion will be sufficient to produce enough additional steam to provide at least 10 percent of the electrical power required to operate the liquefaction facility.

It is believed that the invention will be better understood by reference to the attached FIGURE which illustrates a particularly preferred embodiment of the improved boiler and the improved method of controlling the operation of the same incorporated into a process for the liquefaction of coal or a similar solid carbonaceous material. Referring then to the FIGURE, a finely divided coal or similar solid carbonaceous material is introduced into mixing vessel 10 through line 11 and slurried with a solvent or diluent through line 12. In a preferred embodiment, the solvent will be derived from the solid being subjected to liquefaction, will be hydrogenated to produce hydrogen donor solvent species and will be recycled to the mixing vessel through line 13. During start-up, however, when a recycle solvent is not employed, any of the known useful solvents or diluents may be introduced into line 12 through line 14. The coal or solid carbonaceous material slurry is withdrawn from mixing vessel 10 through line 15 and combined with hydrogen which is introduced into line 15 through line 16. In a particularly preferred embodiment, the hydrogen will be produced from liquefaction bottoms and fed to line 16 through line 17. During start-up, however, or when the bottoms are not used to produce hydrogen, hydrogen from other sources may be introduced into line 16 through line 18. Moreover, while not illustrated, the hydrogen may be introduced directly into the liquefaction vessel in which case the same will, generally, be preheated via other means or the same may be passed through a separate preheating coil in the co-generation boiler. In any case, sufficient hydrogen will be introduced to provide from about 2 to about 8 weight percent hydrogen based on dry, ash-free coal.

In the embodiment illustrated, the combined coal or solid carbonaceous material slurry and hydrogen is passed through a process fluid coil 19 which is located in the convection section 20 of hybrid boiler 21. Prior to passing to the process fluid coil, the slurry may be passed through a preheat exchanger, not illustrated, to effect drying or simply a first stage preheater. In the process fluid coil, the slurry-hydrogen mixture will be preheated to a temperature within the range from about 650° F. to about 850° F. and preferably to a temperature within the range from about 700° F. to about 800° F.

In the convection section 20 of hybrid boiler 21, heat is transferred to the slurry-hydrogen mixture from the combustion flue gas produced in combustion section 22 of the hybrid boiler 21 and from any flue gas recirculated through the combustion section. While not critical to the present invention, the combustion flue gas will follow a path such as that represented by arrows 23–25 and will be withdrawn from the hybrid boiler through line 26. While not illustrated, the flue gas withdrawn will normally be passed through an economizer and an air preheater section to improve overall boiler efficiency. Flue gas recirculated to the combustion section will be separated from line 26 through line 26' and then passed to the combustion section through line 26''.

In the embodiment illustrated, the temperature and flow rate of the slurry feed passing to convection section coil 19 through line 15 are detected with suitable means such as a thermo couple and a pressure cell at 101 and transferred to what is illustrated as a BTU controller 102 through transmission line 103. The BTU controller 102 then controls the extent of opening in flow control valve or damper 104 through a signal transmitted through line 105. As is well known, the signal may be transmitted either pneumatically or electronically. Damper 104, then, controls the amount of flue gas recirculated to the combustion section of hybrid boiler 20. This control is accomplished through what is referred to herein as the feedforward loop.

As previously indicated, the amount of flue gas recirculated will range from 0 to 50 percent of the total amount of flue gas generated by combustion of a fuel in the combustion section of the boiler and this corresponds to from about 0 to about 33 volume percent of the total flue gas passing through the convection section. As previously indicated, the BTU controller will be calibrated to vary the flue gas recirculation rate such that from about 0 to about 33 volume percent of the total flue gas passing through the convection section is recirculated to the combustion section of the boiler.

In the embodiment illustrated, the preheated slurry-hydrogen mixture is withdrawn from the process fluid coil 19 through line 28. The temperature of the slurry in line 28 is measured at 106 with suitable temperature measuring means such as a thermo couple and a signal based on this measurement is transmitted to temperature controller 107 through line 108. The temperature controller, in turn, controls the flow rate of fuel to the combustion section of the boiler with control device 109 through a signal transmitted through line 110. This control is accomplished through what is referred to herein as the feedback loop. Control device 109 could be a pulverizer and the flow control could be effected by controlling the rate of fuel to or from said pulverizer. As in the case of controlling the amount of flue gas recirculation to the combustion section, the signal to flow control valve 109 may be either pneumatic or electronic.

As previously indicated, when the temperature sensed at point 106 is below the point set on temperature controller 107; i.e., the desired coil outlet temperature, the flow rate of fuel to the combustion section will be increased. When the temperature detected at 106 is above the temperature set on controller 107, the flow rate of fuel to the combustion section will be reduced.

The preheated slurry-hydrogen mixture which is withdrawn through line 28 is passed directly to liquefaction vessel 29. In the liquefaction vessel 29, the solid carbonaceous material is at least partially liquefied and, generally, at least a partially gasified. In general, the liquefaction vessel will be sized so as to provide a nominal holding time within the range from about 25 to about 120 minutes and, while a single vessel has been illustrated, a plurality of vessels may be employed. Also, the temperature within the liquefaction zone will, generally, be within the range from about 700° to about 900° F. and the liquefaction will be accomplished at a pressure within the range from about 1000 to about 3000 psig.

In the embodiment illustrated, the combined product from the liquefaction vessel 29 is withdrawn through line 30 and passed to separator 31. In the embodiment illustrated, the separator may be a combined atmospheric and vacuum distillation column wherein gaseous products and products boiling below about 250° F. are withdrawn overhead through line 32 while unconverted solid carbonaceous material and mineral matter and converted materials boiling at a temperature above about 850° to about 1100° F. is withdrawn through line 33. The liquid product is then fractionated into desired cuts and in the embodiment illustrated, a naphtha product boiling within the range from about 250° F. to about 400° F. is withdrawn through line 34, a material boiling within the range from about 400° F. to about 800° F. is withdrawn through line 35 and a heavier fraction boiling from about 800° F. to from about 850° F. to about 1100° F. is withdrawn through line 36. In general, the overhead, gaseous material will comprise gaseous and lower boiling hydrocarbons, steam, acid gases such as $SO_2$ and $H_2S$ and any ammonia which may have been produced during liquefaction. This stream may be scrubbed and further divided to yield a high BTU gas and lighter hydrocarbons. The naphtha stream may be subjected to further upgrading to yield a good quality gasoline and the heavier stream withdrawn through line 36 may be upgraded to produce a heavy fuel oil or cracked and reformed to yield a gasoline boiling fraction. Generally, the solvent boiling range material or at least a portion thereof will be hydrogenated to increase the concentration of hydrogen donor species and recycled to mixing vessel 10 as a solvent or diluent.

As indicated, supra, the particular separation scheme employed is not critical to the present invention and, indeed, any of the separation techniques known in the prior art could be used to effect a separation of the gaseous, liquid and solid products. In any case, however, a bottoms product containing unreacted coal, mineral matter and high-boiling hydrocarbons will be available as a fuel for burning in the improved cogeneration boiler of this invention. Similarly, a solvent boiling range material can be recovered for recycle as the solvent or diluent.

In the preferred embodiment, the solvent fraction withdrawn through line 35 will be hydrogenated before the same is recycled to mixing vessel 10. Preferably, the hydrogenation will be accomplished catalytically at conditions known to be effective for this purpose in the prior art. In the embodiment illustrated, the hydrogenation is accomplished in hydrogenation vessel 37 with molecular hydrogen introduced through line 38 and produced by gasification of a portion of the liquefaction bottoms. During start up, however, and when sufficient hydrogen is not available from bottoms gasification, hydrogen from other sources may be introduced into line 38 through line 39. In the embodiment illustrated, unreacted hydrogen and the gaseous products of hydrogen are withdrawn through line 40. When desired, this gaseous product may be treated to recover recycle hydrogen which may be recombined with hydrogen from the gasification of liquefaction bottoms through line 41. Also in the embodiment illustrated, the hydrogenation product is withdrawn through line 42. In those cases where the amount of liquid withdrawn through line 35 exceeds the amount of solvent required during liquefaction, any excess may be withdrawn through line 43 and the remainder recycled to mixing vessel 10 through lines 13 and 12.

Normally, the hydrogenation will be accomplished at a temperature within the range from about 650° F. to about 850° F. and at a pressure within the range from about 650 to 2000 psig. The hydrogen treat rate during the hydrogenation generally will be within the range from about 1000 to about 10,000 scf/bbl. Any of the known hydrogenation catalyst may be employed, but a nickel-moly catalyst is most preferred.

In a particularly preferred embodiment of the present invention, the bottoms product withdrawn through line 33 may be divided and a portion thereof gasified to produce hydrogen and the remainder subjected to direct combustion as a fuel in boiler 21. In the embodiment illustrated, from about 0 to about 60 percent of the bottoms will be fed through line 44 to gasifier 45. The remaining 40 to about 100 percent will be fed through lines 46'-47'-47" to the combustion section 22 of boiler 21. The bottoms fed to the boiler may be cooled with cooler 48. The bottoms may be combined with additional fuel such as coal introduced into line 47' through line 50 or, in those embodiments wherein bottoms are not employed as fuel, an alternate fuel may still be introduced into the combustion section through lines 47'-47" from line 50.

In general, any gasification technique known in the prior art could be used to convert the bottoms to hydrogen. In a preferred embodiment, however, an entrained flow gasifier will be used to yield a synthesis gas via conversion of the bottoms in the presence of steam and oxygen. The synthesis gas will then be upgraded in accordance with conventional techniques to yield hydrogen. In general, from about 0 to 1 pounds of steam and from about 0.5 to about 1 pound of oxygen per pound of bottoms will be used in the entrained flow gasifier and the gasification will be accomplished at a temperature within the range from about 2000° F. to about 3000° F. In the embodiment illustrated, hydrogen produced in the gasifier is withdrawn through line 46' and combined with any recycle hydrogen that may be available from the hydrogenation and liquefaction vessels. The combined hydrogen then passes through line 47 and is then divided such that hydrogen required for solvent hydrogenation is withdrawn through line 38 and hydrogenation required for liquefaction withdrawn through line 17. The hydrogen withdrawn for solvent hydrogenation is then combined with any makeup hydrogen required and fed to hydrogenation zone 37 through line 38. Similarly, hydrogen required for liquefaction may be combined with any makeup hydrogen required and then combined with the solid carbonaceous material-solvent slurry in line 15. Residue from gasifier 45 is withdrawn through line 49.

In the embodiment illustrated, hydrogen is fed separately to the liquefaction zone and the solvent hydrogenation zone. As is well known in the prior art, however, this is not critical to liquefaction and, indeed, all of the hydrogen produced in the gasifier could be fed first to the solvent hydrogenation zone and then to the liquefaction zone or first to the liquefaction zone and then to the solvent hydrogenation zone. Integrated processes such as these are not, however, subject to the same degree of control as is available when hydrogen is fed separately to the two hydrogenation zones.

In the embodiment illustrated, the fuel flow rate is controlled by control device 109 and fuel enters the combustion section 22 of the boiler through line 47''. In general, the fuel will be introduced through a plurality of nozzles 116—116 which are disposed peripherally around the combustion section of the boiler, each of which may be rotated through an angle Y. In the embodiment illustrated, this angle may range up to 30° below horizontal and 30° above horizontal. For convenience, rotation above the horizontal plane is referred to as a plus (+) angle and rotation below the horizontal plane is referred to as a minus (−) angle. When the nozzles are rotated at a plus angle, combustion occurs at a point or points closer to the convective section and, when the nozzles are rotated in a negative angle, the combustion occurs at a point farther from the convective section of the boiler. It will, of course, be appreciated that while the angle of rotation has been illustrated as a vertical angle, certain boiler designs would facilitate the use of a horizontal angle of rotation to achieve the same variance relative to the radiant section or the steam coils.

In the combustion section 22, then, the fuel will be combusted to produce heat and a heat containing flue gas. From about 50 to about 80 percent of the heat thus produced will be used to produce steam in the radiant section 51 of boiler 21. The steam will be produced by passing boiler feed water introduced through lines 52, 53 and 53' through steam coil 54. The amount of heat actually used to produce steam may be controlled by controlling such variables as the amount of surface area provided in steam coil 54, the quantity of water fed to the coil 54 and the angle of the burners 116—116 in the combustion section 22. In general, the steam produced will be withdrawn from the steam coils or superheater 54 through line 56 at a pressure within the range from about 1000 to about 2000 psig. A part of this steam may then pass to turbo generator 57 and used to produce electricity. The electricity thus produced is transferred to electrical bus 58 through line 59. Electrical bus 58 may be used as a source for some or all electrical power required for the liquefaction operation and the same may be tied to commercially available electricity or electricity available from other sources through line 60 to provide all of the electricity required in the liquefaction process.

In the embodiment illustrated, steam at almost any pressure may be withdrawn for use in the liquefaction process. In the embodiment illustrated, high pressure steam generally at a pressure within the range from about 400 to about 800 psi may be withdrawn through line 61 and a low pressure steam generally at a pressure within the range from about 15 to about 200 psi may be withdrawn through line 62. Condensate from the turbo generator will be withdrawn through line 55 and recycled to steam coils 54 through line 53 and 53'. At least a portion of the ash from the liquefaction bottoms combusted in combustion zone 22 and any ash from the combustion of auxiliary fuels introduced through line 50 will be withdrawn through line 63. The remaining portion may be withdrawn downstream with any suitable means, not illustrated, such as an electrostatic precipitator.

As indicated, supra, and in a most preferred embodiment of the present invention, the steam production rate may be varied from the normal operation rate either automatically or manually by varying the angle of the burners 116—116 through an angle Y ranging from −30° to +30°. When automatic control is used, any suitable means may be employed such as by measuring the steam flow or header pressure with a suitable sensing device 111 which is capable of transmitting a signal to burner angle controller 112 through line 113. The burner angle controller 112 then controls the burner angle with a signal transmitted through lines 115—115 (only partly shown). The signal from the burner angle controller may be transmitted either pneumatically or electronically through lines 115—115.

Having thus broadly described the present invention and a preferred embodiment thereof, it is believed that the same will become more apparent by reference to the following example. It will be appreciated, however, that the example is presently solely for purpose of illustration and should not be construed as limiting the invention.

EXAMPLE

Two computer simulation runs of a cogeneration boiler used to heat a coal slurry from a temperature of 466° F. to a temperature of 840° F. in a process fluid coil in the convection section and to produce steam in the radiant section were completed. In the first simulation, only deviations in the coil outlet temperature from the convection section were used to control the coil outlet temperature by controlling the firing rate with a feedback loop. In the second, the temperature at the coil inlet and the flow rate of process fluid to the process fluid coil was used to control the amount of flue gas recirculated to the combustion section with a feedforward loop and the coil outlet temperature was used to control the amount of fuel fired in the combustion section with a feedback loop. In both simulations, the effect on control of inlet flow variations ranging from a random fluctuation loss of one-third of the process fluid flow was tested. Also, random variations in the coil inlet temperature were tested. Finally, a complete failure of the boiler was programmed into the simulation. The maximum temperature excursions as a result of the upsets were then determined from the similation. When only the feedback control was employed, the maximum temperature excursion at the coil outlet was 56° F. When both the feedforward and feedback control loops of the system of the present invention was used, the maximum temperature excursion was 22° F. This latter maximum excursion is well within the limit of 30° F. necessary to avoid a temperature runaway in the liquefaction reactor and/or coking in the coils.

While the present invention has been described and illustrated by reference to particular embodiments thereof, it will be appreciated by those of ordinary skill in the art that the same lends itself to variations not necessarily illustrated herein. For this reason, then, reference should be made solely to the appendant claims for purposes of determining the true scope of the present invention.

Having thus described and illustrated the invention, what is claimed is:

1. An improved control system for maintaining the outlet temperature of a process fluid exiting from a heat exchange coil within a desired temperature range in a boiler having a radiant section and a convection section comprising means for measuring the inlet temperature and the flow rate of the process fluid adjacent the inlet to said heat exchange coil, first means responsive to changes in said inlet temperature and flow rate to vary the amount of flue gas recirculated from said convection section to said radiant section, means for measuring the temperature of the process fluid adjacent the outlet of said heat exchange coil, a second means responsive to changes in outlet temperature of said process fluid to vary the amount of fuel fed to said radiant section for combustion therein, whereby said first means and said second means, respectively, provide simultaneous feedforward and feedback control in said boiler to maintain the desired process fluid outlet temperature within close tolerances during large upset changes in process fluid inlet temperature or flow rate.

2. The control system of claim 1 in a boiler also having adjustable firing angle burners further including means for measuring the outlet temperature or pressure of steam exiting from a coil located in said radiant section, and a third means responsive to changes in said steam temperature or pressure to vary the firing angle of said burners to maintain the desired steam outlet temperature or pressure.

3. An improved method for maintaining the outlet temperature of a process fluid exiting from a heat exchange coil within a desired temperature range in a boiler having a radiant section and a convection section, comprising the steps of measuring the inlet temperature and the flow rate of the process fluid adjacent the inlet to said heat exchange coil, varying the amount of flue gas recirculated from said convection section to said radiant section in response to changes in said inlet temperature and flow rate, measuring the temperature of the process fluid adjacent the outlet of said heat exchange coil, and varying the amount of combustion fuel fed to said radiant section in response to changes in outlet temperature of said process fluid, whereby simultaneous feedforward and feedback control in said boiler maintains the desired process fluid outlet temperature within close tolerances during large upset changes in process fluid inlet temperature or flow rate.

4. The method of claim 3 wherein the boiler includes adjustable firing angle burners and further includes the steps of measuring the outlet temperature or pressure of steam exiting from a coil located in said radiant section, and varying the firing angle of said burners in response to changes in said steam temperature to maintain the desired steam outlet temperature.

5. An improved boiler capable of producing steam in the radiant section thereof and heating a process fluid in the convection section thereof comprising an improved control system for maintaining the outlet temperature of a process fluid exiting from a heat exchange coil within a desired temperature range in a boiler having a radiant section and a convection section, comprising means in combination therewith for measuring the inlet temperature and the flow rate of a process fluid adjacent the inlet to said heat exchange coil, first means responsive to changes in said inlet temperature and flow rate to vary the amount of flue gas recirculated from said convection section to said radiant section, means for measuring the temperature of the process fluid adjacent the outlet of said heat exchange coil, and second means responsive to changes in outlet temperature of said process fluid to vary the amount of fuel fed to said radiant section for combustion therein, whereby said first means and said second means, respectively, provide simultaneous feedforward and feedback control in said boiler to maintain the desired process fluid outlet temperature within close tolerances during large upset changes in process fluid inlet temperature and flow rate.

6. The improved boiler of claim 5 also having adjustable firing angle burners further in combination with including means for measuring the outlet temperature or pressure of steam exiting from a coil located in said radiant section, and third means responsive to changes in said steam temperature to vary the firing angle of said burners to maintain the desired steam outlet temperature.

* * * * *